US006610645B2

(12) United States Patent
Pancheri et al.

(10) Patent No.: US 6,610,645 B2
(45) Date of Patent: Aug. 26, 2003

(54) SELECTED CRYSTALLINE CALCIUM CARBONATE BUILDER FOR USE IN DETERGENT COMPOSITIONS

(76) Inventors: Eugene Joseph Pancheri, The Procter & Gamble Company, Ivorydale Technical Center, 5299 Spring Grove Ave., Cincinnati, OH (US) 45217; Robert Henry Rohrbaugh, The Procter & Gamble Company, Ivorydale Technical Center, 5299 Spring Grove Ave., Cincinnati, OH (US) 45217; Scott William Capeci, The Procter & Gamble Company, Ivorydale Technical Center, 5299 Spring Grove Ave., Cincinnati, OH (US) 45217; William Marion Hoffman, The Procter & Gamble Company, Ivorydale Technical Center, 5299 Spring Grove Ave., Cincinnati, OH (US) 45217; Rose Marie Weitzel, The Procter & Gamble Company, Ivorydale Technical Center, 5299 Spring Grove Ave., Cincinnati, OH (US) 45217

( * ) Notice: Subject to any disclaimer, the term of this patent is extended or adjusted under 35 U.S.C. 154(b) by 0 days.

(21) Appl. No.: 09/380,906

(22) PCT Filed: Mar. 6, 1998

(86) PCT No.: PCT/US98/04469

§ 371 (c)(1),
(2), (4) Date: Sep. 10, 1999

(87) PCT Pub. No.: WO98/40455

PCT Pub. Date: Sep. 17, 1998

(65) Prior Publication Data

US 2002/0004476 A1 Jan. 10, 2002

(51) Int. Cl.[7] ..... C11D 3/10

(52) U.S. Cl. ..... 510/509; 510/224; 510/229; 510/233; 510/317; 510/318; 510/361; 510/440; 510/435; 510/477; 510/478; 510/531; 510/533

(58) Field of Search ..... 510/224, 229, 510/233, 317, 318, 361, 440, 435, 477, 478, 509, 531, 533

(56) References Cited

U.S. PATENT DOCUMENTS

| | | | | |
|---|---|---|---|---|
| 1,684,782 A | | 9/1928 | Rubinstein | |
| 3,932,316 A | | 1/1976 | Sagel et al. | 252/532 |
| 3,954,649 A | | 5/1976 | Lamberti | 252/174 |
| 3,957,695 A | | 5/1976 | Davies et al. | 252/532 |
| 3,979,314 A | | 9/1976 | Child | 252/140 |
| 3,981,686 A | | 9/1976 | Lobunez et al. | 23/302 T |
| 3,992,314 A | | 11/1976 | Cherney | 252/160 |
| 3,997,692 A | | 12/1976 | Lamberti | 427/215 |
| 4,000,091 A | | 12/1976 | Wentler | 252/524 |
| 4,013,578 A | | 3/1977 | Child et al. | 252/140 |
| 4,022,702 A | | 5/1977 | Curtis | 252/89 R |
| 4,035,257 A | | 7/1977 | Cherney | 252/160 |
| 4,040,988 A | | 8/1977 | Benson et al. | 252/532 |
| 4,049,586 A | | 9/1977 | Collier | 252/532 |
| 4,051,054 A | | 9/1977 | Davies et al. | 252/89 R |
| 4,076,653 A | * | 2/1978 | Davies et al. | 252/532 |
| 4,162,994 A | | 7/1979 | Kowalchuk | 252/532 |
| 4,171,291 A | | 10/1979 | Malhotra et al. | 252/554 |
| 4,196,093 A | | 4/1980 | Clarke et al. | 252/99 |
| 4,348,293 A | | 9/1982 | Clarke et al. | 252/90 |
| 4,352,678 A | | 10/1982 | Jones et al. | 51/307 |
| 4,379,080 A | | 4/1983 | Murphy | 252/526 |
| 4,407,722 A | | 10/1983 | Davies et al. | 252/91 |
| 4,473,485 A | | 9/1984 | Greene | 252/174.12 |
| 4,487,710 A | | 12/1984 | Kaminsky | 252/546 |
| 4,574,053 A | | 3/1986 | Kinsman et al. | 252/134 |
| 4,605,509 A | | 8/1986 | Corkill et al. | 252/131 |
| 4,664,839 A | | 5/1987 | Rieck | 252/175 |
| 4,711,740 A | | 12/1987 | Carter et al. | 252/174.24 |

(List continued on next page.)

FOREIGN PATENT DOCUMENTS

| | | | |
|---|---|---|---|
| CA | 511607 | 4/1955 | |
| DE | 2743001 | 3/1978 | C01F/7/00 |
| DE | 139570 | 9/1980 | C01F/5/24 |
| DE | 158638 | 1/1983 | C01D/7/12 |
| EP | 510746 A2 | 10/1992 | C11D/11/00 |
| EP | 518 576 B1 | 12/1992 | C11D/3/10 |
| EP | 351 937 B1 | 2/1994 | C11D/11/00 |
| EP | 420317 B1 | 11/1994 | C11D/17/06 |
| EP | 630 962 A1 | 12/1994 | C11D/3/10 |
| EP | 451 894 B1 | 5/1995 | C11D/10/04 |
| GB | 607274 | 8/1948 | |
| GB | 868005 | 5/1961 | |
| GB | 1 517 713 | 7/1978 | C11D/17/06 |
| WO | WO93/22411 | 11/1993 | C11D/3/10 |

OTHER PUBLICATIONS

Aspden, "The Composition of Solid Inclusions and the Occurrence of Shortite in Apatites from the Tororo Carbonatite Complex of Eastern Uganda," *Mineralogical Magazine*, 44: 201–204 (Jun. 1981).

Bischoff et al., "Catalysis, Inhibition, and The Calcite–Aragonite Problem," *American Journal of Science*, 266: 65–79 (Feb. 1968).

Bischoff, "Catalysis, Inhibition, and The Calcite–Argonite Problem," *American Journal of Science*, 266:80–90 (Feb. 1968).

(List continued on next page.)

*Primary Examiner*—Mark Kopec
*Assistant Examiner*—Charles Boyer

(57) ABSTRACT

A detergent composition containing an inexpensive detergent builder in the form of a selected crystalline calcium carbonate is provided. Specifically, the crystalline calcium carbonate has a substantially rhombohedral crystal structure with {1,0-1,1} crystallographic indices. The crystalline calcium carbonate can be calcite that has been specially modified to a rhombohedral crystal structure with {1,0-1,1} indices. The crystalline calcium carbonate of the present invention is extremely inexpensive because it can be readily formed from inexpensive naturally occurring calcite, and it performs well even when used at large median particle sizes.

30 Claims, 3 Drawing Sheets

U.S. PATENT DOCUMENTS

| | | | | |
|---|---|---|---|---|
| 4,721,580 | A | 1/1988 | Gosselink | 252/90 |
| 4,820,439 | A | 4/1989 | Rieck | 252/135 |
| 4,828,620 | A | 5/1989 | Mallow et al. | 106/100 |
| 4,846,409 | A | 7/1989 | Kaspar et al. | 241/21 |
| 4,861,503 | A | 8/1989 | Hollingsworth et al. | 252/135 |
| 4,894,177 | A | 1/1990 | Starch | 252/174.15 |
| 4,900,466 | A | 2/1990 | Atkinson et al. | 252/174.14 |
| 4,908,159 | A | 3/1990 | Davies et al. | 252/559 |
| 4,919,847 | A | 4/1990 | Barletta et al. | 252/558 |
| 4,966,606 | A | 10/1990 | Garner-Gray et al. | 252/174.14 |
| 5,108,646 | A | 4/1992 | Beerse et al. | 252/174.25 |
| 5,133,924 | A | 7/1992 | Appel et al. | 264/342 R |
| 5,160,657 | A | 11/1992 | Bortolotti et al. | 252/174.14 |
| 5,205,958 | A | 4/1993 | Swatling et al. | 252/174.13 |
| 5,219,541 | A | 6/1993 | Zolotoochin | 423/198 |
| 5,364,610 | A | 11/1994 | Merris, Jr. | 423/432 |
| 5,366,652 | A | 11/1994 | Capeci et al. | 252/89.1 |
| 5,427,711 | A | 6/1995 | Sakaguchi et al. | 252/174.25 |
| 5,449,660 | A | 9/1995 | Munakata et al. | 505/441 |
| 5,554,587 | A | 9/1996 | Capeci | 510/444 |
| 5,565,137 | A | 10/1996 | Capeci | 510/216 |
| 5,658,867 | A | 8/1997 | Pancheri et al. | 510/108 |
| 5,707,959 | A | 1/1998 | Pancheri et al. | 510/144 |
| 5,731,279 | A | 3/1998 | Pancheri | 510/340 |
| 5,733,865 | A | 3/1998 | Pancheri et al. | 510/531 |

OTHER PUBLICATIONS

Bischoff et al., "Gaylussite Formation at Mono Lake, California," *Geochimica et Cosmochimica Acta*, 55: 1743–1747 (1991).

Castro et al., "Influence of Quebracho and Sodium Silicate on Flotation of Celestite and Calcite with Soduim Oleate," *International Journal of Mineral Processing*, 37: 283–298 (1993).

Cooper, Gittins and Tuttle, "The System $Na_2Co_3$–$K_2CO_3$–$CaCO_3$ at 1 Kilobar and its Significance in Carbonatite Petrogenesis," *American Journal of Science*, 275: 534–560 (1975).

Dickens et al., "The Crystal Structures of $CaNa_2(CO_3)_2 \cdot 5H_2O$. Synthetic Gaylussite, and $CaNa_2(CO_3)_2 \cdot 2H_2O$, Synthetic Pirssonite," *Inorganic Chemistry*, 8(10): 2093–2103 (Oct. 1969).

Evans and Milton, "Crystallography of the Heating Products of Gaylussite and Pirssonite," *Abstracts of ACA Sessions on Mineralogical Crystallography*, 1104 (1973).

Fahey, "Shortite, a New Carbonate of Sodium and Calcium," *U.S. Geological Survey*, 514–518. No year available.

Frankis et al., "Subsolidus Relations in the System $Na_2Co_3$–$CaCO_3$–$H_2O$," *Nature Physical Science*, 246: 124–125 (1973).

Friedman et al., "Economic Implications of the Deuterium Anomaly in the Brine and Salts in Searles Lake, California," *Scientific Communications*, 694–702 (1981).

Gadalla et al., "Calcination of Sodium–Calcium Carbonates in Air," *Ind. Eng. Chem. Fundam.*, 23: 220–223 (1984).

Johnson and Robb., "Gaylussite: Thermal Properties by Simultaneous Thermal Analysis," *American Mineralogist*, 58: 778–784 (1973).

Milton and Axelrod., "Fused Wood–ash Stones: Fairchildite (n.sp.) $K_2CO_3 \cdot CaCO_3$, Buetschilite (n.sp.) $3K_2CO_3 \cdot 2CaCO_3 \cdot 6H_2O$ and Calcite $CaCO_3$, Their Essential Components," *U.S. Geological Survey*: 607–622. No year available.

Naviglio and Moriconi., "Detergents Manufacture," *Soap/Cosmetics/Chemical Specialties*,: 34–37, 54, 56 (Sep. 1987).

Nemeth et al. "General–Purpose Abrasive Cleaners," *Chemical Abstracts*, 115(14): (Oct. 1991) (Abstract).

Pabst., "Systhesis, Properties, and Structure of $K_2Ca(CO_3)_2$, Buetschliite," *American Mineralogist*, 59: 353–358 (1974).

Plummer and Busenberg., "The Solubilities of Calcite, Argonite and Vaterite in $CO_2$–$H_2O$ Solutions Between 0 and 90° C, and an Evaluation of the Aqueous Model for the System $CaCO_3$–$CO_2$–$H_2O$," *Geochimica et Cosmochimica Acta*, 46:1011–1040 (1982).

Smith et al., "Thermal Synthesis of Sodium Calcium Carbonate–A Potential Thermal Analysis Standard," *Thermochimica Acta*, 2: 305–312 (1971).

* cited by examiner

SELECTED CRYSTALLINE CALCIUM CARBONATE BUILDER FOR USE IN DETERGENT COMPOSITIONS

CROSS-REFERENCE TO RELATED APPLICATIONS

This application claims the benefit of International Application No. PCT/US98/04469, filed Mar. 6, 1998, which claims the benefit of the priority of U.S. Provisional Application No. 60/036,680, filed Mar. 11, 1997, the disclosures of which are hereby incorporated herein by reference.

FIELD OF THE INVENTION

The invention is directed to an inexpensive builder material for use in detergent compositions. More particularly, the invention provides a selected crystalline calcium carbonate material substantially having a rhombohedral crystalline structure with {1,0-1,1} crystallographic indices. This very inexpensive builder material is especially suitable for use in detergent compositions used in fabric laundering, bleaching, automatic or hand dishwashing, hard surface cleaning and in any other application which requires the use of a builder material to remove water hardness.

BACKGROUND OF THE INVENTION

It is common practice for formulators of cleaning compositions to include, in addition to a cleaning active material, a builder to remove hardness cations (e.g. calcium cations and magnesium cations) from washing solution which would otherwise reduce the efficiency of the cleaning active material (e.g. surfactant) and render certain soils more difficult to remove. For example, laundry detergent compositions typically contain an anionic surfactant and a builder to reduce the effects of hardness cations in wash solutions. In this context, the builder sequesters or "ties up" the hardness cations so as to prevent them from hindering the cleaning action of the anionic surfactant in the detergent composition.

As is well known, water-soluble phosphate materials have been used extensively as detergency builders. However for a variety of reasons, including eutrophication of surface waters allegedly caused by phosphates, there has been a desire to use other builder materials in many geographic areas. Other known builders include water-soluble builder salts, such as sodium carbonate, which can form precipitates with the hardness cations found in washing solutions. Unfortunately, the use of such builders alone does not reduce the level of hardness cations at a sufficiently rapid rate. For practical purposes, the acceptable level is not reached within the limited time required for the desired application, e.g. within 10 to 12 minutes for fabric laundering operations in North America and Japan.

Moreover, some of these water-soluble builder salts, while attractive from the point of view of cost, have several disadvantages, among which are the tendency of the precipitates formed in aqueous washing solutions (e.g. insoluble calcium carbonate) to become deposited on fabrics or other articles to be cleaned. One alleged solution to this problem has been to include a water-insoluble material which would act as a "seed crystal" for the precipitate (i.e. calcium carbonate). Of the many materials suggested for such use, very small particle size calcite has been the most popular.

However, the inclusion of calcite in detergent compositions has been problematic because of the sensitivity of the hardness cation/salt anion (e.g. calcium/carbonate) reaction product to poisoning by materials (e.g. polyacrylate or certain anionic surfactants) which may be present in the washing solution. Without being limited by theory, the poisoning problem prevents the reaction product from forming in that crystallization onto the seed crystal is inhibited. Consequently, calcite typically has to be produced in a very small particle size in order to have a larger surface area which is harder to poison. This, however, renders the very small calcite particle dusty and difficult to handle. Moreover, the required particle sizes are so small (at least having 15 $m^2/g$ or more of surface area) that manufacturing of such calcite particles is extremely expensive. For example, production of such small calcite particles may require a controlled "growing" process which is extremely expensive. Another problem associated with the use of calcite as a "seed crystal" for the poisons and precipitates in washing solutions is the difficulty experienced in adequately dispersing the calcite in the washing solution so that it does not deposit on fabrics or articles which have been subjected to cleaning operations. Such deposits or residues are extremely undesirable for most any cleaning operation, especially in fabric laundering and tableware cleaning situations.

The prior art is replete with suggestions for dealing with the handling and dispersability problems associated with calcite. One previously proposed means for handling calcite is to incorporate it into a slurry, but this involves high storage and transportation costs. Another proposed option involves granulating calcite with binding and dispersing agents to ensure adequate dispersment in the wash solution. However, this option also has been difficult to implement effectively in modern day detergent compositions because the calcite granules have poor mechanical strength which continue to make them difficult to handle and process. Additionally, effective binding and dispersing agents for the calcite have not been discovered to date. Specifically, most of the binding and dispersing agents proposed by the prior art are themselves poisons which reduce the "seed activity" of the calcite. Consequently, it would be desirable to have an improved inexpensive builder material which overcomes the aforementioned limitations and is easy to handle, readily dispersible in washing solutions and exhibits improved builder performance.

Several additional builder materials and combinations thereof have also been used extensively in various cleaning compositions for fabric laundering operations and dish or tableware cleaning operations. By way of example, certain clay minerals have been used to adsorb hardness cations, especially in fabric laundering operations. Further, the zeolites (or aluminosilicates) have been suggested for use in various cleaning situations. Various aluminosilicates have also been used as detergency builders. For example, water-insoluble aluminosilicate ion exchange materials have been widely used in detergent compositions throughout the industry. While such builder materials are quite effective and useful, they account for a significant portion of the cost in most any fully formulated detergent or cleaning composition. In addition, such builders have a limited calcium sequestration capacity, and thus, are not very effective in hard water. Therefore, it would be desirable to have a builder material which performs as well as or better than the aforementioned builders, and importantly, is also less expensive.

Accordingly, despite the aforementioned disclosures, there remains a need in the art for an inexpensive builder material for use in detergent compositions which exhibits superior performance and is less expensive to manufacture in that it does not require a very small particle size. There is also a need in the art for such a builder material which is easy to handle (i.e., is not "dusty"), easy to process and readily disperses in washing solutions.

BACKGROUND ART

The following references are directed to builders for various detergent compositions: Atkinson et al, U.S. Pat. No. 4,900,466 (Lever); Houghton, WO 93/22411 (Lever); Allan et al, EP 518 576 A2; (Lever); Zolotoochin, U.S. Pat. No. 5,219,541 (Tenneco Minerals Company); Gamer-Gray et al. U.S. Pat. No. 4,966,606 (Lever); Davies et al, U.S. Pat. No. 4,908,159 (Lever); Carter et al, U.S. Pat. No. 4,711,740 (Lever); Greene, U.S. Pat. No. 4,473,485 (Lever); Davies et al, U.S. Pat. No. 4,407,722 (Lever); Jones et al, U.S. Pat. No. 4,352,678 (Lever); Clarke et al, U.S. Pat. No. 4,348,293 (Lever); Clarke et al, U.S. Pat. No. 4,196,093 (Lever); Benjamin et al, U.S. Pat. No. 4,171,291 (Procter & Gamble); Kowalchuk, U.S. Pat. No. 4,162,994 (Lever); Davies et al, U.S. Pat. No. 4,076,653 (Lever); Davies et al, U.S. Pat. No. 4,051,054 (Lever); Collier, U.S. Pat. No. 4,049,586 (Procter & Gamble); Benson et al, U.S. Pat. No. 4,040,988 (Procter & Gamble); Cherney, U.S. Pat. No. 4,035,257 (Procter & Gamble); Curtis, U.S. Pat. No. 4,022,702 (Lever); Child et al, U.S. Pat. No. 4,013,578 (Lever); Lamberti, U.S. Pat. No. 3,997,692 (Lever); Cherney, U.S. Pat. No. 3,992,314 (Procter & Gamble); Child, U.S. Pat. No. 3,979,314 (Lever); Davies et al, U.S. Pat. No. 3,957,695 (Lever); Lamberti, U.S. Pat. No. 3,954,649 (Lever); Sagel et al U.S. Pat. No. 3,932,316 (Procter & Gamble); Lobunez et al, U.S. Pat. No. 3,981,686 (Intermountain Research and Development Corp.); Mallow et al, U.S. Pat. No. 4,828,620 (Southwest Research Institute); Bjorklund et al, "Adsorption of Anionic and Cationic Polymers on Porous and Non-porous Calcium Carbonate Surfaces," *Applied Surface Science* 75 pp. 197–203 (1994); Wierzbicki et al, "Atomic Force Microscopy and Molecular Modeling of Protein and Peptide Binding to Calcite," *Calcified Tissue International* 54, pp. 133–141 (1994); Park et al, "Tribological Enhancement of $CaCO_3$ Dissolution during Scanning Force Microscopy," Langmuir, pp. 4599–4603, 12 (1996); and Nancollas et al, "The Crystallization of Calcium Carbonate," *Journal of Colloid and Interface Science,* Vol. 37, No. 4, pp. 824–829 (December 1971).

SUMMARY OF THE INVENTION

The aforementioned needs in the art are met by the present invention which provides a detergent builder in the form of a calcium carbonate that is in an especially selected crystalline form. Specifically, the crystalline calcium carbonate has a substantially rhombohedral crystal structure with {1,0-1,1} crystallographic indices. The crystalline calcium carbonate can be calcite that has been specially modified to the rhombohedral crystal structure with {1,0,-1,1} indices. The crystalline calcium carbonate of the present invention is extremely inexpensive because it can be readily formed from inexpensive naturally occurring calcite and it performs well even when used at large median particle sizes.

In accordance with one aspect of the invention, a detergent composition is provided. The detergent composition comprises: (a) an effective amount of crystalline calcium carbonate, the crystalline calcium carbonate substantially having a rhombohedral crystalline structure with {1,0,-1,1} crystallographic indices; and (b) at least about 1% by weight of a detersive surfactant.

In a preferred aspect of the invention, a detergent composition having especially preferred features is provided. This detergent composition comprises: (a) from about 0. 1% to about 80% by weight of crystalline calcium carbonate, the crystalline calcium carbonate substantially having a rhombohedral crystalline structure with {1,0,-1,1} crystallographic indices and a surface area of from about 0.01 $m^2/g$ to about 4 $m^2/g$; (b) at least about 1% by weight of a detersive surfactant; and (c) from about 1% to about 80% by weight of sodium carbonate, wherein the sodium carbonate and the crystalline calcium carbonate are in a weight ratio of about 1:5 to about 5:1. This detergent composition is substantially free of phosphates.

The invention also provides a method for laundering soiled fabrics comprising the steps of contacting the soiled fabrics with an aqueous solution containing an effective amount of a detergent composition as described herein. Also provided is a method for cleaning surfaces comprising the steps of contacting the surfaces with an aqueous solution containing an effective amount of a detergent composition as described herein. Any of the detergent compositions described herein may be in the form of a laundry bar. In yet another method aspect of the invention, a method of removing calcium hardness ions from an aqueous solution is provided. This method comprises the step of dispersing crystalline calcium carbonate substantially having a rhombohedral crystalline structure with {1,0,-1,1} crystallographic indices into the aqueous solution, the calcium hardness ions crystallizing on the crystalline calcium carbonate resulting in the removal of the calcium hardness ions from the aqueous solution.

Accordingly, it is an object of the invention to provide a detergent composition containing an inexpensive builder material which exhibits superior performance and is less expensive to manufacture in that it does not require a very small particle size. It is also an object of the invention to provide such a builder material which is easy to handle (i.e.. is not "dusty"), easy to process and readily disperses in washing solutions. These and other objects, features and attendant advantages of the present invention will become apparent to those skilled in the art from a reading of the following detailed description of the preferred embodiment and the appended claims.

All percentages, ratios and proportions used herein are by weight (anhydrous basis) unless otherwise specified. All documents including patents and publications cited herein are incorporated herein by reference.

BRIEF DESCRIPTION OF THE DRAWINGS

(FIG. 8 is a partial perspective depicting only the top portion of the crystal), all of which are outside the scope of the invention.

DETAILED DESCRIPTION OF THE PREFERRED EMBODIMENT

The detergent composition of the invention can be used in a variety of applications including but not limited to fabric laundering, fabric or surface bleaching, automatic or hand dishwashing, hard surface cleaning and any other application which requires the use of a builder material to remove water hardness.

Figure 1:
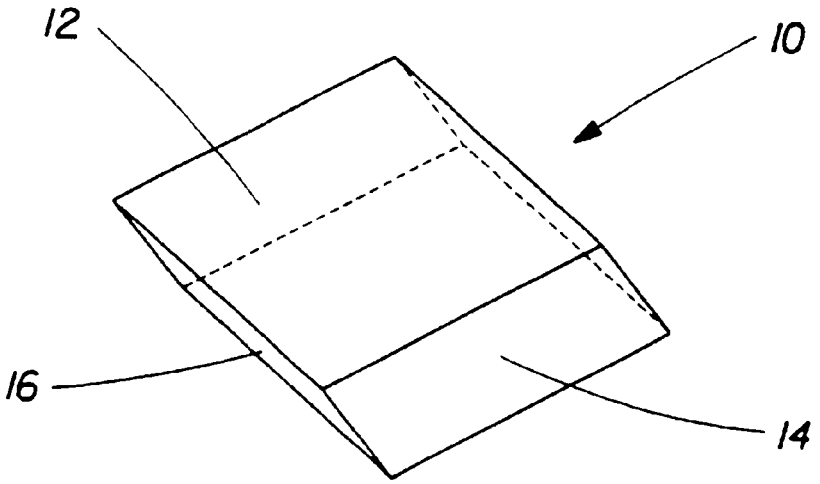
FIG. 1 illustrates a crystalline calcium carbonate structure in accordance with the invention.

As used herein, the phrase "effective amount" means that the level of the builder material in the composition is sufficient to sequester an adequate amount of hardness in the washing solution such that the detersive surfactant is not overly inhibited. As used herein, the word "crystalline" means a mixture or material having a regularly repeating internal arrangement (i.e., "lattice") of its atoms and external plane faces. As used herein, the phrase "substantially having a rhombohedral crystalline structure" means a crystal having the form of a parallelogram and no right angles (e.g., as depicted in FIG. 1). As used herein, "{1,0,-1,1} crystallographic indices" refers to a specific set of crystal planes on a hexagonal coordinate system which defines a selected crystalline structure (also referenced as the "Miller indices" for a hexagonal coordinate system). As used herein, the phrase "crystalline calcium carbonate" refers to the chemical entity, calcium carbonate, in crystalline form, of which the most common form is referenced as "calcite". Also see standard texts on all of these subjects, such as Blackburn et al, *Principles of Mineralogy,* 2nd Ed., pp. 21–51 (1994) and Klein et al, *Manual of Mineralogy,* p. 405 et seq (1977).

Crystalline Calcium Carbonate Builder

The crystalline calcium carbonate used in the detergent composition of the present invention has a substantially rhombohedral crystalline structure 10 as depicted in FIG. 1. This crystalline calcium carbonate is defined by {1,0,-1,1} crystallographic or Miller indices. It has been surprisingly found that by judiciously selecting a crystalline calcium carbonate of such a crystalline configuration, superior builder performance (i.e., removal of water hardness) can be achieved when used in typical detergent compositions for laundering soiled clothes. The median particle size of this crystalline calcium carbonate as detailed hereinafter is not required to be in the very small range (e.g., less than about 2 microns with a surface areas at least about 15 $m^2/g$).

While not intending to be bound by theory, it is believed that the outer surfaces, e.g., 12, 14 and 16 depicted in FIG. 1, have a significantly high population of oxygen atoms which lends the entire crystalline structure to have more of an affinity to calcium cations which is the predominant source of water hardness. Those skilled in the art will appreciate that this is a crystal having {1,0,-1,1} crystallographic indices and its crystal faces are defined thereby. By contrast, FIGS. 2–8 define crystal structures of crystalline calcium carbonate or calcite which do not substantially have a rhombohedral crystalline structure with {1,0,-1,1} crystallographic indices. Moreover, all of the crystal faces or cleavage planes of the calcite crystal structures depicted in FIGS. 2–8 can have a much higher population of calcium atoms, thereby creating a strong positive charge on the outer surfaces of these crystals. This, as those skilled in the art will appreciate, does cause these crystalline structures to be less effective at sequestering water hardness cations.

Figure 2:
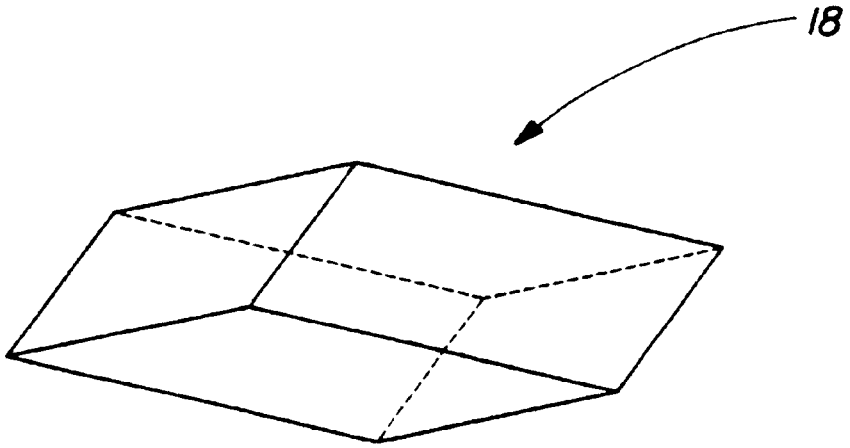
FIGS. 2–8 illustrate naturally occurring crystalline calcium carbonate structures that are commonly found in nature
Figure 3:
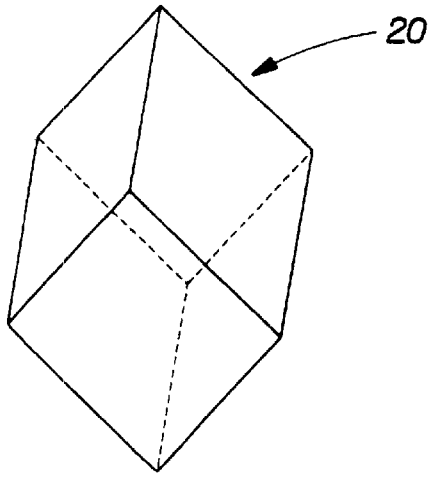
Figure 4:
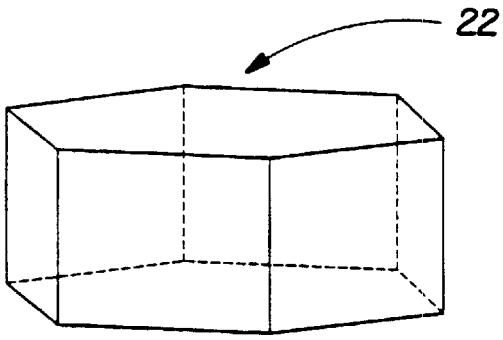
Figure 5:
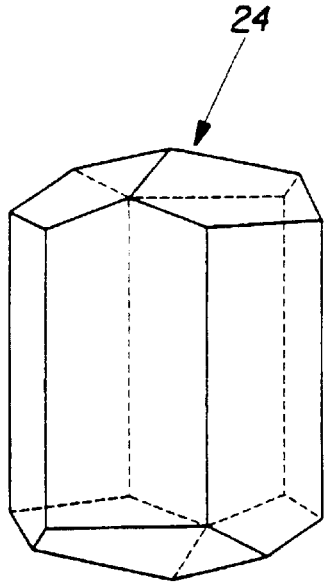
Figure 6:
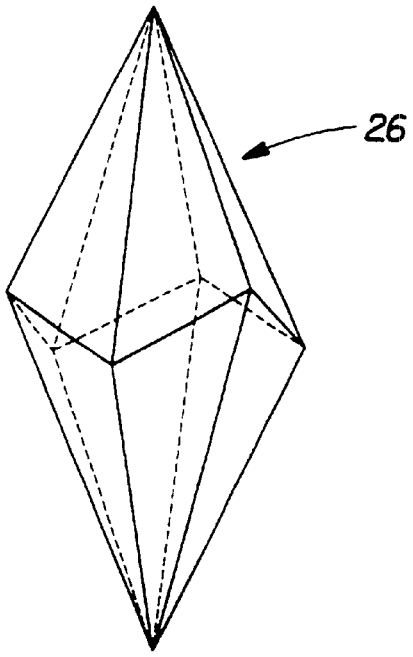
Figure 7:
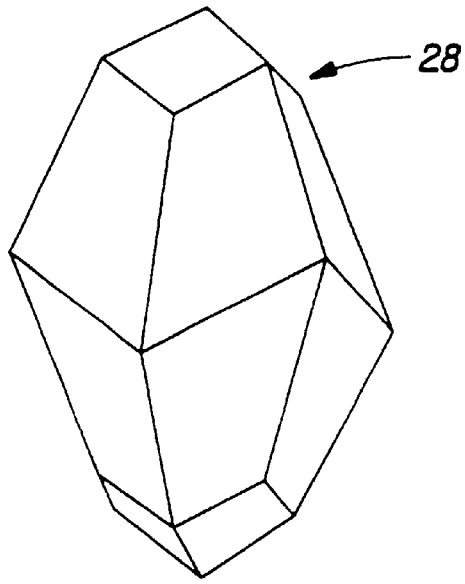
Figure 8:
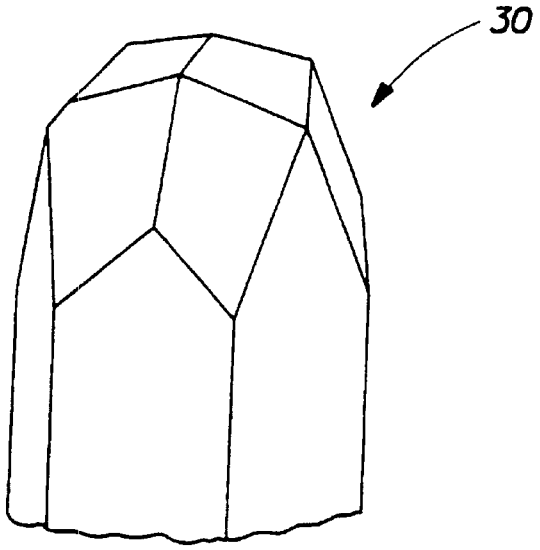

Specifically, FIG. 2 depicts a crystalline calcium carbonate having a rhombohedral structure 18, but with {0,1,-1,2} crystallographic indices. FIG. 3 illustrates crystalline calcium carbonate or calcite in a cubic crystal structure 20 having {0,2,–2,1} crystallographic indices. FIG. 4 depicts a hexagonal crystal structure 22 with {1,0,-1,0} and {0,0,0,1} crystallographic indices, while FIG. 5 shows a prismatic structure 24 with {1,0,-1,0} and {0,1,-1,2} crystallographic indices. FIG. 6 depicts a crystalline calcium carbonate structure 26 having {2,1,–3,1} crystallographic indices, and FIG. 7 illustrates a scalenohedral calcite crystal structure 28 with {2,1,–3,1} and small faces with the preferred {1,0,-1,1} crystallographic indices. Lastly, FIG. 8 illustrates a top partial perspective view of yet another calcium carbonate crystalline structure 30 which has {0,1,-1,2}, {2,1,–3,1} and {1,0,-1,0} crystallographic indices.

FIGS. 3, 4, 5 and 7 depict the most common calcite crystals found in nature. It should be understood that none of these calcite crystal structures are in the form of FIG. 1 which is within the scope of the invention. Furthermore, it is believed that the calcite crystal structures of FIGS. 2–8 do not perform as well as the FIG. 1 structure because the FIGS. 2–8 structures have a high population of calcium atoms at their respective crystal planes (i.e., outer surfaces), thereby resulting in poor performance relative to water hardness cation sequestration. To the contrary, as mentioned previously, the calcite crystal depicted in FIG. 1 has a high population of oxygen atoms and low population of calcium atoms on its respective cleavage planes (i.e., {1,0,-1,1} crystallographic indices) rendering it a particularly effective seed crystal for water hardness cation (e.g., calcium cations) sequestration. This results in a superior performing detergent composition as the deleterious effects of water hardness on surfactant performance is eliminated or severely inhibited.

The "crystalline" nature of the builder material can be detected by X-ray Diffraction techniques known by those skilled in the art. X-ray diffraction patterns are commonly collected using Cu $K_{alpha}$ radiation on an automated powder diffractometer with a nickel filter and a scintillation counter to quantify the diffracted X-ray intensity. The X-ray diffraction diagrams are typically recorded as a pattern of lattice spacings and relative X-ray intensities. In the Powder Diffraction File database by the Joint Committee on Powder Diffraction Standards—International Centre for Diffraction Data, X-ray diffraction diagrams of corresponding preferred builder materials include, but are not limited to, the following numbers: 5-0586 and 17-0763.

The actual amount of crystalline calcium carbonate builder used in the detergent composition of the invention will vary widely depending upon the particular application. However, typical amounts are from about 0.1% to about 80%, more typically from about 4% to about 60%, and most typically from about 6% to about 40%, by weight of the detergent composition. The median particle size of the builder is preferably from about 0.2 microns to about 20 microns, more preferably from about 0.3 microns to about 15 microns, even more preferably from about 0.4 microns to about 10 microns, and most preferably from about 0.5 microns to about 10 microns. While the crystalline calcium carbonate builder used in the detergent composition herein performs at any median particle size, it has been found that optimum overall performance can be achieved within the aforementioned median particle size ranges.

The phrase "median particle size" as used herein means the particle size as measured by the particle's diameter of a given builder in which 50% by weight of the population has a higher particle size and 50% has a lower particle size. The median particle size is measured at its usage concentration in water (after 10 minutes of exposure to this water solution at a temperature of 50 F. to 130 F.) as determined by conventional analytical techniques such as, for example, microscopic determination using a scanning electron microscope (SEM), Coulter Counter or Malvern particle size instruments. In general, the particle size of the builder not at its usage concentration in water can be any convenient size.

In addition to the median particle size or in the alternative to it, the crystalline calcium carbonate builder preferably has selected surface area for optimal performance. More specifically, the crystalline calcium carbonate has a surface area of from about 0.01 $m^2/g$ to about 12 $m^2/g$, more preferably from about 0.1 $m^2/g$ to about 10 $m^2/g$, even more preferably from about 0.2 $m^2/g$ to about 5 $m^2/g$, and most preferably from about 0.2 $m^2/g$ to about 4 $m^2/g$. Other suitable surface area ranges include from about 0.1 $m^2/g$ to about 4 $m^2/g$ and from about 0.01 $m^2/g$ to about 4 $m^2/g$. The surface areas can be measured by standard techniques including by nitrogen adsorption using the standard Bruauer, Emmet & Teller (BET) method. A suitable machine for this method is a Carlo Erba Sorpty 1750 instrument operated according to the manufacturer's instructions.

The crystalline calcium carbonate builder used in the detergent composition herein also unexpectedly has improved builder performance in that it has a high calcium ion exchange capacity. In that regard, the builder material has a calcium ion exchange capacity, on an anhydrous basis, of at least about 100 mg equivalent of calcium carbonate hardness/gram, more preferably at least about 200 mg, and even more preferably at least about 300 mg, and most preferably from at least about 400 mg, equivalent of calcium carbonate hardness per gram of builder. Additionally, the builder unexpectedly has an improved calcium ion exchange rate. On an anhydrous basis, the builder material has a calcium carbonate hardness exchange rate of at least about 5 ppm, more preferably from about 10 ppm to about 150 ppm, and most preferably from about 20 ppm to about 100 ppm, $CaCO_3$/minute per 200 ppm of the builder material. A wide variety of test methods can be used to measure the aforementioned properties including the procedure exemplified hereinafter and the procedure disclosed in Corkill et al, U.S. Pat. No. 4,605,509 (issued Aug. 12, 1986), the disclosure of which is incorporated herein by reference.

In a preferred embodiment of the invention, the detergent composition is substantially free of phosphates and phosphonates. As used herein, "substantially free" means has less than 0.05% by weight of a given material. Alternatively, or in addition to the foregoing phosphate limitation, the detergent composition is substantially free of soluble silicates, especially if magnesium cations are part of the water hardness composition in the particular use and the detergent composition of the invention does not include an auxiliary builder to sequester such cations. In this regard, superior performance of the detergent composition containing the aforedescribed builder can be achieved if the detergent composition is substantially free of polycarboxylates, polycarboxylic oligomer/polymers and the like. It has also been found that optimal performance can be achieved using such materials in the detergent composition so long as the polycarboxylate is pre-blended with the surfactant before exposure to the crystalline calcium carbonate, either during manufacture of the detergent composition or during use.

In another preferred aspect of the invention, the detergent composition is substantially free of potassium salts, or if they are present, are included at very low levels. Specifically, the potassium salts are included at levels of about 0.01% to about 5%, preferably at about 0.01% to about 2% by weight of the detergent composition.

Preferably, if sodium sulfate and sodium carbonate are included in the detergent composition, they are preferably in a weight ratio of about 1:50 to about 2:1, more preferably from about 1:40 to about 1:1, most preferably from about 1:20 to about 1:1 of sodium sulfate to sodium carbonate. While not intending to be bound by theory, it is believed that excessive amounts of sulfate relative to carbonate may interfere with the builder performance of the crystalline calcium carbonate. Preferably, if sodium carbonate is included in the detergent composition, it is included preferably in a weight ratio of about 1:1 to about 20:1, more preferably from about 1:1 to about 10:1, most preferably from about 1:1 to about 5:1 of sodium carbonate to crystalline calcium carbonate builder. Additionally or in the alternative, sodium carbonate is present in the detergent composition in an amount of from about 2% to about 80%, more preferably from about 5% to about 70%, and most preferably from about 10% to about 50% by weight of the detergent composition.

The crystalline calcium carbonate in accordance with the invention (FIG. 1) can be made in a variety of ways so long as the resulting crystal substantially has a rhombohedral crystalline structure with {1,0,-1,1} crystallographic indices. Preferably, the starting ingredient is crystalline calcium carbonate which does not have the aforementioned crystal structure. There are a multitude of possible starting crystalline calcium carbonates suitable for use in the process. By way of example, naturally occurring calcite such as the one depicted in FIG. 5 can be mined or commercially purchased and subjected to the process described hereinafter.

As used herein, the word "milling" means crushing, grinding or otherwise affecting the physical structure of the crystalline calcium carbonate. In a preferred embodiment, the process first involves feeding starting crystalline calcium carbonate into an apparatus having an internal chamber and air nozzles directed into the chamber. One convenient apparatus in which such milling can occur is an Alpine Fluid Bed Jet Mill (Model 100 AFG Fluid Bed Jet Mill commercially available from Hosokawa Micron—Alpine, Germany). Other suitable apparatus are commercially available from Hosokawa Micron—Alpine, Germany are sold under the trade names Table Top Roller Mill, Aeroplex, Ecoplex and Turboplex. In this step of the process, the starting crystalline calcium carbonate is milled in such apparatus by inputting and grinding with air at a pressure from about 1 bar to about 50 bar, more preferably from about 1.5 bar to about 10 bar, and most preferably from about 2.5 bar to about 5 bar. In this way, the starting crystalline calcium carbonate is converted to a rhombohedral crystalline structure with {1,0,-1,1} crystallographic indices, thereby forming the detergent builder.

This selected milling process step in which the starting ingredient (e.g., calcite) is milled involves crushing and/or grinding the starting crystalline calcium carbonate such that it is cleaved to form the aforementioned crystalline calcite structure (FIG. 1). While not intending to be bound by theory, it is believed that the {1,0,-1,1} crystallographic indices define "low stress" planes of larger naturally occurring calcite along which cleavage can occur if milled with selected process parameters.

One or more auxiliary builders can be used in conjunction with the crystalline calcium carbonate builder described herein to further improve the performance of the detergent composition described herein. For example, the auxiliary builder can be selected from the group consisting of aluminosilicates, crystalline layered silicates, MAP zeolites, citrates, polycarboxylates, sodium carbonates and mixtures thereof. Other suitable auxiliary builders are described hereinafter.

Detergent Compositions

The detergent compositions of the invention can contain all manner of organic, water-soluble detergent compounds, inasmuch as the builder material are compatible with all such materials. In addition to a detersive surfactant, at least one suitable adjunct detergent ingredient is preferably included in the detergent composition. The adjunct detergent ingredient is preferably selected from the group consisting of auxiliary builders, enzymes, bleaching agents, bleach activators, suds suppressors, soil release agents, brighteners, perfumes, hydrotropes, dyes, pigments, polymeric dispersing agents, pH controlling agents, chelants, processing aids, crystallization aids, and mixtures thereof. The following list of detergent ingredients and mixtures thereof which can be used in the compositions herein is representative of the detergent ingredients, but is not intended to be limiting.

Detersive Surfactant

Preferably, the detergent compositions herein comprise at least about 1%, preferably from about 1% to about 55%, and most preferably from about 10 to 40%, by weight, of a detersive surfactant selected from the group consisting of anionic surfactants, nonionic surfactants, cationic surfactants, zwitterionic surfactants and mixtures. Nonlimiting examples of surfactants useful herein include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3$ $(CH_2)_y$ $(CHOSO_3^{31}$ $M^+)$ $CH_2CH_3$ where x and (y+l) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

It should be understood, however, that certain surfactants are less preferred than others. For example, the $C_{11}$–$C_{18}$ alkyl benzene sulfonates ("LAS") and the sugar based surfactants are less preferred, although they may be included in the compositions herein, in that they may interfere or otherwise act as a poison with respect to the builder material.

Adjunct Ingredients

Auxiliary Detersive Builder—Auxiliary detergent builders can optionally be included with the aforedescribed builder material in the compositions herein to assist further in controlling mineral hardness in the washing solutions. Inorganic as well as organic builders can be used. Also, crystalline as well as amorphous builder materials can be used. Builders are typically used in fabric laundering compositions to assist in the removal of particulate soils.

The level of builder can vary widely depending upon the end use of the composition and its desired physical form. When present, the compositions will typically comprise at least about 1% builder. Granular formulations typically comprise from about 10% to about 80%, more typically from about 15% to about 50% by weight, of the detergent builder. Lower or higher levels of builder, however, are not meant to be excluded.

Inorganic or phosphorous-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders. Preferably, as mentioned, phosphate builders should be excluded, but if used, are present at less than about 10% of the composition. Layered silicates and sodium carbonate are the most preferred co-builders for the instant builder.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Examples of carbonate builders are the alkaline earth and alkali metal carbonates as disclosed in German Patent Application No. 2,321,001 published on Nov. 15, 1973.

As mentioned previously, aluminosilicate builders are useful auxiliary builders in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(AlO_2)_z.(SiO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

As mentioned, use of organic detergent builders relating to the wide variety of polycarboxylate compounds should be minimal, and preferably not used at all. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other similar detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetracetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders which are suitable due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other similar polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders are used, and especially in the formulation mulation of bars used for hand-laundering operations, the various alkali metal phosphates such as the well-known sodium tripolyphosphates, sodium pyrophosphate and sodium orthophosphate can be used at low levels. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used at low levels, although elimination of such materials from the composition is preferred.

Enzymes—Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The additional enzymes to be incorporated include cellulases, proteases, amylases, lipases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders as well as their potential to cause malodors during use. In this respect bacterial or fungal enzymes are preferred, such as bacterial amylases and proteases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

The cellulase suitable for the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola strain* DSM1800 or a cellulase 212-producing fungus belonging to the genus Aeromonas, and cellulase extracted from the hepatopancreas of a marine mollusk (*Dolabella Auricula Solander*), suitable cellulases are also disclosed in GB-A-2.075.028; GB-A-2.095.275 and DE-OS-2.247.832. In addition, cellulase especially suitable for use herein are disclosed in WO 92-13057 (Procter & Gamble). Most preferably, the cellulases used in the instant detergent compositions are purchased commercially from NOVO Industries A/S under the product names CAREZYME® and CELLUZYME®.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the trade names ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art. and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for certain detergent formulations, and their incorporation into such formulations, are disclosed in U.S. Pat. No. 4,261,868, Hora et al, issued Apr. 14. 1981. Enzymes for use in detergents can be stabilized by various techniques. Typical granular or powdered detergents can be stabilized effectively by using enzyme granulates. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706. Typical detergents, especially liquids, will comprise from about 1 to about 30, preferably from about 2 to about 20, more preferably from about 5 to about 15, and most preferably from about 8 to about 12, millimoles of calcium ion per liter of finished composition. This can vary somewhat, depending on the amount of enzyme present and its response to the calcium or magnesium ions. The level of calcium or magnesium ions should be selected so that there is always some minimum level available for the enzyme, after allowing for complexation with builders, fatty acids, etc., in the composition. Any water-soluble calcium or magnesium salt can be used as the source of calcium or magnesium ions, including, but not limited to, calcium chloride, calcium sulfate, calcium malate, calcium maleate, calcium hydroxide, calcium formate, and calcium acetate, and the corresponding magnesium salts. A small amount of calcium ion, generally from about 0.05 to about 0.4 millimoles per liter, is often also present in the composition due to calcium in the enzyme slurry and formula water. In solid detergent compositions the formulation may include a sufficient quantity of a water-soluble calcium ion source to provide such amounts in the laundry liquor. In the alternative, natural water hardness may suffice.

It is to be understood that the foregoing levels of calcium and/or magnesium ions are sufficient to provide enzyme stability. More calcium and/or magnesium ions can be added to the compositions to provide an additional measure of grease removal performance. Accordingly, as a general proposition the compositions herein will typically comprise from about 0.05% to about 2% by weight of a water-soluble source of calcium or magnesium ions, or both. The amount can vary, of course, with the amount and type of enzyme employed in the composition.

The compositions herein may also optionally, but preferably, contain various additional stabilizers, especially borate-type stabilizers. Typically, such stabilizers will be used at levels in the compositions from about 0.25% to about 10%, preferably from about 0.5% to about 5%, more preferably from about 0.75% to about 3%, by weight of boric acid or other borate compound capable of forming boric acid in the composition (calculated on the basis of boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

The compositions herein may also include ammonium salts and other chlorine scavengers such those disclosed by Pancheri et al, U.S. Pat. No. 4,810,413 (issued Mar. 7, 1989), the disclosure of which is incorporated herein by reference.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0. 1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartnan, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,55 1, incorporated herein by reference.

Another class of bleach activators comprises the benzoxazin-type activators disclosed by Hodge et al in U.S. Pat. No. 4,966,723. issued Oct. 30, 1990, incorporated herein by reference. A highly preferred activator of the benzoxazin-type is:

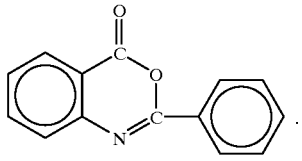

Still another class of preferred bleach activators includes the acyl lactam activators, especially acyl caprolactams and acyl valerolactams of the formulae:

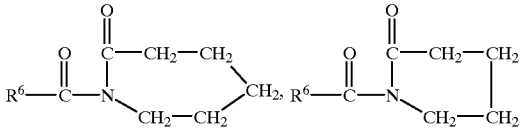

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactarn, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference. which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photo activated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549.272A1, 544,440A2, and 544,490A 1: Preferred examples of these catalysts include $Mn^{IV}{}_2(u\text{-}O)_3$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4(ClO_4)_4$, $Mn^{III}Mn^{IV}{}_4(u\text{-}O)_1(u\text{-}OAc)_2$(1,4,7-trimethyl-1,4,7-triazacyclononane)$_2(ClO_4)_3$, $Mn^{IV}$(1,4,7-trimethyl-1,4,7-triazacyclononane)$(OCH_3)_3(PF_6)$, and mixtures thereof. Other metal-based bleach catalysts include those disclosed in U.S. Pat. Nos. 4,430,243 and 5,114,61 1. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor. Preferably, the detergent composition of the present invention includes at least about 5 ppm of perborate or percarbonate.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from DuPont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediam inetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

While it is preferred to eliminate the following chelating agents from the detergent composition of the invention, minimal amounts of amino phosphonates may be used, and include ethylenediaminetetrakis (methylenephosphonates) as DEQUEST. Preferred. these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although the polcarboxylates should be used at very low levels, eliminated, or premixed with the surfactant as discussed previously. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition. One such polymeric material which is especially suitable for the current composition is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000. Polyaspartate and polyglutamate dispersing agents may also be used, especially in conjunction with zeolite builders. Dispersing agents such as polyaspartate preferably have a molecular weight (avg.) of about 10,000.

Brightener—Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-stryl-phenyl)-2H-napthol[1,2-d]triazoles; 4,4'-bis-(1,2,3-triazol-2-yl)-stil-benes; 4,4'-bis(stryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiopene; 2-stryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylprrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N-O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

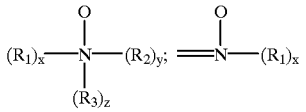

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis* Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

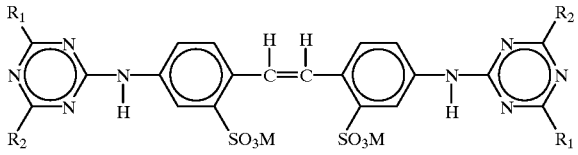

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the trade name Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the trade name Tinopal SBM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the trade name Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Suds Suppressors—Compounds for reducing or suppressing the formation of suds can be incorporated into the compositions of the present invention. Suds suppression can be of particular importance in the so-called "high concentration cleaning process" and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters, the latter phosphates only being used at very low levels. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. No. 4,978,471, Starch, issued Dec. 18, 1990, and U.S. Pat. No. 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount. By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional suds and to enhance grease removal performance although addition of magnesium ions is not conducive to the highest levels of performance from the builder material described herein.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes. bleaches, bleach activators, bleach catalysts, photo activators, dyes, fluorescers, fabric conditioners and hydrolyzable surfactants can be "protected" for use in detergents, including liquid laundry detergent compositions.

The detergent compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

Various amounts of processing aids such as sugars, for example those sugars disclosed in U.S. Pat. No. 4,908,159, Davies et al, issued Mar. 13, 1990, and starches can be used in the compositions herein. Other suitable processing aids include those described in U.S. Pat. No. 4,013,578, Child et al, issued Mar. 22, 1977. Various amounts of crystallization aids such as those described in U.S. Pat. No. 3,957,695, Davies et al, issued May 18, 1976, can be used in the composition herein, as well. Hydrotropes may also be used in the compositions of the invention such as those described in U.S. Pat. No. 5,478,503, Swift, issued Dec. 26, 1995. Further, combinations of admixed citric acid and sodium carbonate may be included as described in U.S. Pat. No. 5,338,476, Pancheri et al, Aug. 16, 1994.

In order to make the present invention more readily understood, reference is made to the following examples, which are intended to be illustrative only and not intended to be limiting in scope.

EXAMPLE I

Calcium Sequestration and Rate of Sequestration Test

The following illustrates a step-by-step procedure for determining the amount of calcium sequestration and the rate thereof for the crystalline calcium carbonate builder used in the compositions described herein.

1. Add to 750 ml of 35° C. distilled water, sufficient water hardness concentrate to produce 171 ppm of CaCO3;
2. Stir and maintain water temperature at 35° C. during the experiment;
3. Add 1.0 ml of 8.76% KOH to the water;
4. Add 0.1085 gm of KCl;
5. Add 0.188 gm of Glycine;
6. Stir in 0.15 gm of $Na_2CO_3$;
7. Adjust pH to 10.0 using 2N HCl and maintain throughout the test;
8. Stir in 0.15 gm of a builder according the invention and start timer;
9. Collect an alliquot of solution at 30 seconds, quickly filter it through a 0.22 micron filter, quickly acidify it to pH 2.0 –3.5 and seal the container;
10. Repeat step 9 at 1 minute, 2 minutes, 4 minutes, 8 minutes, and 16 minutes;
11. Analyze all six alliquots for $CaCO_3$ content via ion selective electrode, titration, quantitative ICP or other appropriate technique;
12. The Sequestration rate in ppm $CaCO_3$ sequestered per 200 ppm of builder is 171 minus the $CaCO_3$ concentration at one minute;
13. Amount of sequestration (in ppm $CaCO_3$ per gram/liter of builder) is 171 minus the $CaCO_3$ concentration at 16 minutes times five.

For the builder material particle sizes according to the instant invention which are on the low end of the median particle size range, a reference sample is needed which is run without hardness in order to determine how much of the builder passes through the filter. The above calculations should then be corrected to eliminate the contribution of the builder to the apparent calcium concentration.

EXAMPLES II–IV

Several detergent compositions made in accordance with the invention and specifically for top-loading washing machines are exemplified below. The base granule is prepared by a conventional spray drying process in which the starting ingredients are formed into a slurry and passed though a spray drying tower having a countercurrent stream of hot air (200–300° C.) resulting in the formation of porous granules. The admixed agglomerates are formed from two feed streams of various starting detergent ingredients which are continuously fed, at a rate of 1400 kg/hr. into a Lödige CB-30 mixer/densifier, one of which comprises a surfactant paste containing surfactant and water and the other stream containing starting dry detergent material containing aluminosilicate and sodium carbonate. The rotational speed of the shaft in the Lödige CB-30 mixer/densifier is about 1400 rpm and the mean residence time is about 1–10 seconds. The contents from the Lodige CB-30 mixer/idensifier are continuously fed into a Lodige KM-600 mixer/densifier for further agglomeration during which the mean residence time is about 6 minutes. The resulting detergent agglomerates are then fed to a fluid bed dryer and to a fluid bed cooler before being admixed with the spray dried granules. The remaining adjunct detergent ingredients are sprayed on or dry added to the blend of agglomerates and granules.

| | II | III | IV |
|---|---|---|---|
| Base Granule | | | |
| Calcite (rhombohedral, {1,0,−1,1}) | 3.0 | 16.0 | 11.0 |
| Aluminosilicate | 15.0 | 2.0 | 11.0 |
| Sodium sulfate | 10.0 | 10.0 | 19.0 |
| Sodium polyacrylate polymer | 3.0 | 3.0 | 2.0 |
| Polyethylene Glycol (MW = 4000) | 2.0 | 2.0 | 1.0 |
| $C_{12-13}$ linear alkylbenzene sulfonate, Na | 6.0 | 6.0 | 7.0 |
| $C_{14-16}$ secondary alkyl sulfate, Na | 3.0 | 3.0 | 3.0 |
| $C_{14-15}$ alkyl ethoxylated sulfate, Na | 3.0 | 3.0 | 9.0 |
| Sodium silicate | — | 0.1 | 0.2 |
| Brightener 24[6] | 0.3 | 0.3 | 0.3 |
| Sodium carbonate | 7.0 | 7.0 | 25.7 |
| DTPA[1] | 0.5 | 0.5 | — |
| Admixed Agglomerates | | | |
| $C_{14-15}$ alkyl sulfate, Na | 5.0 | 5.0 | — |
| $C_{12-13}$ linear alkylbenzene sulfonate, Na | 2.0 | 2.0 | — |
| $NaKCa(CO_3)_2$ | — | 7.0 | — |
| Sodium Carbonate | 4.0 | 4.0 | — |
| Polyethylene Glycol (MW = 4000) | 1.0 | 1.0 | — |
| Admix | | | |
| $C_{12-15}$ alkyl ethoxylate (EO = 7) | 2.0 | 2.0 | 0.5 |
| Perfume | 0.3 | 0.3 | 1.0 |
| Polyvinylpyrrilidone | 0.5 | 0.5 | — |
| Polyvinylpyridine N-oxide | 0.5 | 0.5 | — |
| Polyvinylpyrrolidone-polyvinylimidazole | 0.5 | 0.5 | — |
| Distearylamine & Cumene sulfonic acid | 2.0 | 2.0 | — |
| Soil Release Polymer[2] | 0.5 | 0.5 | — |
| Lipolase Lipase (100.000 LU/I)[4] | 0.5 | 0.5 | — |
| Termamyl amylase (60 KNU/g)[4] | 0.3 | 0.3 | — |
| CAREZYME ® cellulase (1000 CEVU/g)[4] | 0.3 | 0.3 | — |
| Protease (40 mg/g)[5] | 0.5 | 0.5 | 0.5 |
| NOBS[3] | 5.0 | 5.0 | — |
| Sodium Percarbonate | 12.0 | 12.0 | — |
| Polydimethylsiloxane | 0.3 | 0.3 | — |
| Miscellaneous (water, etc.) | balance | balance | balance |
| Total | 100 | 100 | 100 |

[1]Diethylene Triamine Pentaacetic Acid
[2]Made according to U.S. Pat. No. 5,415,807, issued May 16, 1995 to Gosselink et al
[3]Nonanoyloxybenzenesulfonate
[4]Purchased from Novo Nordisk A/S
[5]Purchased from Genencor
[6]Purchased from Ciba-Geigy

EXAMPLES V–XVI

The following detergent compositions accordance with the invention are especially suitable for front loading washing machines. The compositions are made in the manner of Examples II–IV.

| | (% Weight) | | |
|---|---|---|---|
| | V | VI | VII |
| Base Granules | | | |
| $Na_2Ca_2(CO_3)_3$ | 24.0 | — | 8.0 |
| Calcite (rhombohedral, {1,0,−1,1}) | — | 24.0 | 8.0 |
| Aluminosilicate | — | — | 8.0 |
| Sodium sulfate | 6.0 | 6.0 | 6.0 |
| Acrylic Acid/Maleic Acid Co-polymer | 4.0 | 4.0 | 4.0 |
| $C_{12-13}$ linear alkylbenzene sulfonate, Na | 8.0 | 8.0 | 8.0 |
| Sodium silicate | — | 0.1 | 0.2 |
| Carboxymethylcellulose | 1.0 | 1.0 | 1.0 |
| Brightener 47 | 0.3 | 0.3 | 0.3 |
| Silicone antifoam | 1.0 | 1.0 | 1.0 |
| DTPMPA[1] | 0.5 | 0.5 | 0.5 |
| Admixed | | | |
| $C_{12-15}$ alkyl ethoxylate (EO = 7) | 2.0 | 2.0 | 2.0 |
| $C_{12-15}$ alkyl ethoxylate (EO = 3) | 2.0 | 2.0 | 2.0 |
| Perfume | 0.3 | 0.3 | 0.3 |
| Sodium carbonate | 13.0 | 13.0 | 13.0 |
| Sodium perborate | 18.0 | 18.0 | 18.0 |
| Sodium perborate | 4.0 | 4.0 | 4.0 |
| TAED[2] | 3.0 | 3.0 | 3.0 |
| Savinase protease (4.0 KNPU/g)[3] | 1.0 | 1.0 | 1.0 |
| Lipolase lipase (100.000 LU/l)[3] | 0.5 | 0.5 | 0.5 |
| Termamyl amylase (60 KNU/g)[3] | 0.3 | 0.3 | 0.3 |
| Sodium sulfate | 3.0 | 3.0 | 5.0 |
| Miscellaneous (water, etc.) | balance | balance | balance |
| Total | 100.0 | 100.0 | 100.0 |

[1]Diethylene Triamine Pentamethylenephosphonic Acid
[2]Tetra Acetyl Ethylene Diamine
[3]Purchased from Novo Nordisk A/S

| | (% Weight) | | |
|---|---|---|---|
| | VIII | IX | X |
| Base Granule | | | |
| Aluminosilicate | 14.0 | — | — |
| Calcite (rhombohedron, {1,0,−1,1}) | 1.0 | 15.0 | — |
| Sodium Sulfate | 2.0 | 2.0 | — |
| $C_{12-13}$ linear alkylbenzene sulfonate, Na | 3.0 | 3.0 | — |
| DTPMPA[1] | 0.5 | 0.5 | — |
| Carboxymethylcellulose | 0.5 | 0.5 | — |
| Acrylic Acid/Maleic Acid Co-polymer | 4.0 | 4.0 | — |
| Admixed Agglomerates | | | |
| $C_{14-15}$ alkyl sulfate, Na | — | — | 11.0 |
| $C_{12-13}$ linear alkylbenzene sulfonate, Na | 5.0 | 5.0 | — |
| Tallow alkyl sulfate | 2.0 | 2.0 | — |
| Sodium silicate | — | 0.1 | — |
| Aluminosilicate | 11.0 | 12.0 | 6.0 |
| Calcite (rhombohedral, {1,0,−1,1}) | 1.0 | — | 7.0 |
| Carboxymethylcellulose | — | — | 0.5 |
| Acrylic Acid/Maleic Acid Co-polymer | — | — | 2.0 |
| Sodium Carbonate | 8.0 | 8.0 | 7.0 |
| Admixed | | | |
| Perfume | 0.3 | 0.3 | 0.5 |
| $C_{12-15}$ alkyl ethoxylate (EO = 7) | 4.0 | 4.0 | 4.0 |
| $C_{12-15}$ alkyl ethoxylate (EO = 3) | 2.0 | 2.0 | 2.0 |
| Acrylic Acid/Maleic Acid Co-polymer | — | — | 3.0 |
| Crystalline layered silicate[2] | — | — | 12.0 |
| Sodium citrate | 5.0 | 5.0 | 8.0 |
| Sodium bicarbonate | 5.0 | 5.0 | 5.0 |
| Sodium carbonate | 6.0 | 6.0 | 15.0 |
| Polyvinylpyrrilidone (PVP) | 0.5 | 0.5 | 0.5 |
| Alcalase protease[3] (3.0 AU/g) | 0.5 | 0.5 | 1.0 |
| Lipolase lipase[3] (100.000 LU/l) | 0.5 | 0.5 | 0.5 |

-continued

| | (% Weight) | | |
|---|---|---|---|
| | VIII | IX | X |
| Termamyl amylase[3] (60 KNU/g) | 0.5 | 0.5 | 0.5 |
| CAREZYME ® cellulase[3] (1000 CEVU/g) | 0.5 | 0.5 | 0.5 |
| Sodium sulfate | 4.0 | 4.0 | 0.0 |
| Miscellaneous (water, etc.) | balance | balance | balance |
| Total | 100.0 | 100.0 | 100.0 |

[1]Diethylene Triamine Pentamethylenephosphonic Acid
[2]SKS 6 commercially available from Hoechst
[3]Purchased from Novo Nordisk A/S

| | XI | XII | XIII |
|---|---|---|---|
| Base Granules | | | |
| Aluminosilicate | — | 8.0 | 7.0 |
| Calcite (rhombohedral, {1,0,−1,1}) | 15.0 | 7.0 | 8.0 |
| Sodium Sulfate | 2.0 | 2.0 | 0.0 |
| $C_{12-13}$ linear alkylbenzene sulfonate, Na | 3.0 | 3.0 | 3.0 |
| Cationic Surfactant[1] | 1.0 | 1.0 | 1.0 |
| DTPMPA[2] | 0.5 | 0.5 | 0.5 |
| Carboxymethylcellulose | 0.5 | 0.5 | 0.5 |
| Acrylic Acid/Maleic Acid Co-polymer | 3.0 | 3.0 | 2.0 |
| Admixed Agglomerates | | | |
| $C_{12-13}$ linear alkylbenzene sulfonate, Na | 5.0 | 5.0 | 5.0 |
| Tallow alkyl sulfate | 2.0 | 2.0 | 2.0 |
| Sodium silicate | — | 0.1 | 0.2 |
| Aluminosilicate | 8.0 | 8.0 | 8.0 |
| Sodium carbonate | 8.0 | 8.0 | 4.0 |
| Admix | | | |
| Perfume | 0.3 | 0.3 | 0.3 |
| $C_{12-15}$ alkyl ethoxylate (EO = 7) | 2.0 | 2.0 | 2.0 |
| $C_{12-15}$ alkyl ethoxylate (EO = 3) | 1.0 | — | 1.0 |
| Sodium citrate | 2.0 | 2.0 | 2.0 |
| Sodium bicarbonate | 1.0 | 1.0 | — |
| Sodium carbonate | 11.0 | 11.0 | 10.0 |
| TAED[3] | 4.0 | 4.0 | 5.0 |
| Sodium perborate | 10.0 | 10.0 | 10.0 |
| Polyethylene oxide | — | — | 0.3 |
| Bentonite | — | — | 10.0 |
| Savinase protease (4.0 KNPU/g)[4] | 1.0 | 1.0 | 1.0 |
| Lipolase lipase (100.000 LU/g)[4] | 0.5 | 0.5 | 0.5 |
| Termamyl amylase (60 KNU/g)[4] | 0.5 | 0.5 | 0.5 |
| CAREZYME ® cellulase (1000 CEVU/g)[4] | 0.5 | 0.5 | 0.5 |
| Sodium sulfate | 1.0 | 1.0 | — |
| Miscellaneous (water, etc.) | balance | balance | balance |
| Total | 100.0 | 100.0 | 100.0 |

[1]$C_{12-14}$ Dimethyl Hydroxyethyl Quaternary Ammonium Compound
[2]Diethylene Triamine Pentamethylenephosphonic Acid
[3]Tetra acetyl ethylene diamine
[4]Purchased from Novo Nordisk A/S

| | (% Weight) | | |
|---|---|---|---|
| | XIV | XV | XVI |
| Agglomerate | | | |
| $C_{12-13}$ linear alkylbenzene sulfonate, Na | 5.0 | 5.0 | 5.0 |
| $C_{14-16}$ secondary alkyl sulfate, Na | 3.0 | 3.0 | 3.0 |
| $C_{14-15}$ alkyl sulfate, Na | 9.0 | 9.0 | 9.0 |
| Aluminosilicate | 1.0 | — | 9.0 |
| Calcite (rhombohedral, {1,0,−1,1}) | 9.0 | 10.0 | 1.0 |
| Sodium carbonate | 6.0 | 6.0 | 6.0 |

-continued

| | (% Weight) | | |
|---|---|---|---|
| | XIV | XV | XVI |
| Acrylic/Maleic Co-polymer | 3.0 | 3.0 | 3.0 |
| Carboxymethylcellulose | 0.5 | 0.5 | 0.5 |
| DTPMPA[1] | 0.5 | 0.5 | 0.5 |
| Admix | | | |
| $C_{12-15}$ alkyl ethoxylate (EO = 5) | 5.0 | 5.0 | 5.0 |
| Perfume | 0.5 | 0.5 | 0.5 |
| Crystalline layered silicate[2] | 5.0 | — | 10.0 |
| Calcite (rhombohedral, {1,0,−1,1}) | 5.0 | 10.0 | — |
| HEDP[3] | 0.5 | 0.5 | 0.5 |
| Sodium citrate | 2.0 | 2.0 | 3.0 |
| TAED[4] | 6.0 | 6.0 | 6.0 |
| Sodium percarbonate | 20.0 | 20.0 | 20.0 |
| Soil Release Polymer[5] | 0.3 | 0.3 | 0.3 |
| Savinase protease (4 KNPU/g)[6] | 1.5 | 1.5 | 1.5 |
| Lipolase lipase (100,000 LU/g)[6] | 0.5 | 0.5 | 0.5 |
| CAREZYME ® cellulase (1000 CEVU/g)[6] | 0.5 | 0.5 | 0.5 |
| Termamyl amylase (60 KNU/g)[6] | 0.5 | 0.5 | 0.5 |
| Silica/Silicone suds suppresser | 5.0 | 5.0 | 5.0 |
| Brightener 49[7] | 0.3 | 0.3 | 0.3 |
| Brightener 47[7] | 0.3 | 0.3 | 0.3 |
| Miscellaneous (water, etc.) | balance | balance | balance |
| Total | 100.0 | 100.0 | 100.0 |

[1]Diethylene Triamine Pentamethylenephosphonic Acid
[2]SKS 6 commercially available from Hoechst
[3]Hydroxyethylidene 1,1 Diphosphonic Acid
[4]Tetra acetyl ethylene diamine
[5]Made according to U.S. Pat. No. 5,415,807, issued May 16, 1995, to Gosselink et al
[6]Purchased from Novo Nordisk A/S
[7]Purchased from Ciba-Geigy

EXAMPLES XVII–XVIII

The following detergent compositions according to the invention are suitable for low wash volume, top loading washing machines. The compositions are made in the manner of Examples II–IV.

| | (% Weight) | |
|---|---|---|
| | XVII | XVIII |
| Base Granules | | |
| Calcite (rhombohedral, {1,0,−1,1}) | 7.0 | 3.0 |
| Aluminosilicate | — | 4.0 |
| Sodium sulfate | 3.0 | 3.0 |
| Polyethylene Glycol (MW = 4000) | 0.5 | 0.5 |
| Acrylic Acid/Maleic Acid Co-polymer | 6.0 | 6.0 |
| Cationic Surfactant[1] | 0.5 | 0.5 |
| $C_{14-16}$ secondary alkyl sulfate, Na | 7.0 | 7.0 |
| $C_{12-13}$ linear alkylbenzene sulfonate, Na | 13.0 | 13.0 |
| $C_{14-15}$ alkyl ethoxylated sulfate, Na | 6.0 | 6.0 |
| Crystalline layered silicate[2] | 6.0 | 6.0 |
| Sodium silicate | — | 0.1 |
| Oleic Fatty Acid, Na | 1.0 | 1.0 |
| Brightener 49[7] | 0.3 | 0.3 |
| Sodium carbonate | 28.0 | 28.0 |
| DTPA[3] | 0.3 | 0.3 |
| Admix | | |
| $C_{12-15}$ alkyl ethoxylate (EO = 7) | 1.0 | 1.0 |
| Perfume | 1.0 | 1.0 |
| Calcite (rhombohedral, {1,0,−1,1}) | 2.0 | 3.0 |
| Soil Release Polymer[4] | 0.5 | 0.5 |
| Polyvinylpyrrilidone | 0.3 | 0.3 |
| Polyvinylpyridine N-oxide | 0.1 | 0.1 |

-continued

| | (% Weight) | |
|---|---|---|
| | XVII | XVIII |
| Polyvinylpyrrolidone-polyvinylimidazole | 0.1 | 0.1 |
| Lipolase Lipase (100,000 LU/I)[6] | 0.3 | 0.3 |
| Termamyl amylase (60 KNU/g)[6] | 0.1 | 0.1 |
| CAREZYME ® cellulase (1000 CEVU/g)[6] | 0.1 | 0.1 |
| Savinase (4.0 KNPU/g)[6] | 1.0 | 1.0 |
| NOBS[5] | 4.0 | 4.0 |
| Sodium Perborate Monohydrate | 5.0 | 5.0 |
| Miscellaneous (water, etc.) | balance | balance |
| Total | 100.0 | 100.0 |

[1]$C_{12-14}$ Dimethyl Hydroxyethyl Quaternary Ammonium Compound
[2]SKS 6 commercially available from Hoechst
[3]Diethylene Triamine Pentaacetic Acid
[4]Made according to U.S. Pat. No. 5,415,807, issued May 16, 1995, to Gosselink et al
[5]Nonanoyloxybenzenesulfonate
[6]Purchased from Novo Nordisk A/S
[7]Purchased from Ciba-Geigy

EXAMPLE XIX–XXI

The following detergent compositions according to the invention are especially suitable for handwashing operations.

| | (% Weight) | | |
|---|---|---|---|
| | XIX | XX | XXI |
| $C_{12-13}$ alkylbenzene sulfonate, Na | 18.0 | 18.0 | 18.0 |
| Cationic Surfactant[1] | 1.0 | 1.0 | 1.0 |
| N-Cocoyl N-Methyl Glucamine | 0.5 | 0.5 | 0.5 |
| $C_{12-13}$ $AE_7$ or $C_{14-15}$ $AE_7$ | 1.0 | 1.0 | 1.0 |
| $C_{14-15}$ $AE_{0.6}S$ | 1.0 | 1.0 | 1.0 |
| Sodium tripolyphosphate | — | 2.0 | 2.0 |
| Calcite (rhombohedral, {1,0,−1,1}) | 22.0 | 10.0 | 2.0 |
| $Na_2Ca_2(CO_3)_3$ | — | 10.0 | 18.0 |
| Sodium silicate (2.0R) | — | 0.1 | 0.2 |
| Sodium carbonate | 29.0 | 29.0 | 29.0 |
| Sodium bicarbonate | 3.0 | 3.0 | 3.0 |
| DTPMPA[2] | 0.5 | 0.5 | 0.5 |
| Soil Release Polymer[3] | 0.1 | 0.1 | 0.1 |
| Acrylic/Maleic Co-polymer | 1.0 | 1.0 | 1.0 |
| Carboxymethylcellulose | 0.3 | 0.3 | 0.3 |
| Savinase[5] (44.0 KNPU/g) | 0.5 | 0.5 | 0.5 |
| Termamyl[5] (60 KNU/g) | 0.3 | 0.3 | 0.3 |
| Lipolase (100.000 LU/I)[5] | 0.1 | 0.1 | 0.1 |
| CAREZYME ®[5] (1000 CEVU/g) | 0.1 | 0.1 | 0.1 |
| Zinc Phthalocyanine Sulfonate | 9.0 | 9.0 | 9.0 |
| Brightener 49/15[6] | 0.3 | 0.3 | 0.3 |
| Sodium perborate | 1.0 | 1.0 | 1.0 |
| NOBS[4] | 0.5 | 0.5 | 0.5 |
| Misc. (water, etc.) | balance | balance | balance |
| Total | 100.0 | 100.0 | 100.0 |

[1]$C_{12-14}$ Dimethyl Hydroxyethyl Quaternary Ammonium Compound
[2]Diethylene Triamine Pentamethylenephosphonic Acid
[3]Made according to U.S. Pat. No. 5,415,807, issued May 16, 1995, to Gosselink et al
[4]Nonanoyloxybenzenesulfonate
[5]Purchased from Novo Nordisk A/S
[6]Purchased from Ciba-Geigy

EXAMPLE XXII

The following detergent composition according to the invention is in the form of a laundry bar which is particularly suitable for handwashing operations.

| | (% Weight) XXII |
|---|---|
| Coconut Fatty Alkyl Sulfate | 30.0 |
| Sodium Tripolyphosphate | 1.0 |
| Tetrasodium Pyrophosphate | 1.0 |
| Sodium Carbonate | 20.0 |
| Sodium Sulfate | 5.0 |
| Calcite (rhombohedral, {1,0,−1,1}) | 20.0 |
| Aluminosilicate | 10.0 |
| Coconut Fatty Alcohol | 2.0 |
| Perfume | 1.0 |
| Miscellaneous (water, etc.) | balance |
| Total | 100.0 |

EXAMPLES XIII–XXIV

The following detergent compositions according to the invention are especially suitable for automatic dishwashing machines are exemplified herein.

| | (% Weight) | |
|---|---|---|
| | XXIII | XXIV |
| Calcite (rhombohedral, {1,0,−1,1}) | 12.0 | 8.0 |
| Sodium Citrate Dihydrate | 5.0 | 7.0 |
| Acusol 988N (480N + HEDP)[1] | 15.0 | 15.0 |
| Sodium carbonate | 16.0 | 16.0 |
| Sodium sulfate | 6.0 | 6.0 |
| Sodium perborate Monohydrate | 10.0 | 10.0 |
| TAED[2] | 2.0 | 2.0 |
| Sodium Disilicate | — | 0.1 |
| Savinase[3] (6.0T) | 1.0 | 1.0 |
| Termamyl[3] (60T) | 0.5 | 0.5 |
| Protease[4] (40 mg/g) | 0.5 | 0.5 |
| Perfume | 1.0 | 1.0 |
| Miscellaneous (water, etc.) | balance | balance |
| Total | 100 | 100 |

[1]Hydroxyethylidene 1,1 Diphosphonic Acid
[2]Tetra acetyl ethylene diamine
[3]Purchased from Novo Nordisk A/S
[4]Purchased from Genencor

EXAMPLES XXV–XXVI

These Examples present liquid detergent compositions in accordance with the invention.

| | (% Weight) | |
|---|---|---|
| | XXV | XXVI |
| Surfactant/Builder | | |
| $C_{12-13}$ alkyl ethoxylated (EO = 7) | 2.0 | 10.0 |
| $C_{12-15}$ alkyl ethoxylated sulfate | 34.0 | — |
| N-Cocoyl N-Methyl Glucamine | 9.0 | — |
| $C_{12-14}$ Fatty Acid | 2.0 | — |
| Oleic Fatty Acid | — | 4.0 |
| Citric Acid | 6.0 | 17.0 |

-continued

| | (% Weight) | |
|---|---|---|
| | XXV | XXVI |
| $C_{12-13}$ linear alkylbenzene sulfonate, H | — | 16.0 |
| Aluminosilicate | — | 4.0 |
| Calcite (rhombohedral, {1,0,−1,1}) | 2.0 | 20.0 |
| Functional Additives/Process Aids | | |
| Oba 49 (Cbs-X)[1] | — | 0.1 |
| Boric Acid | 11.0 | — |
| Sodium Metaborate | — | 2.0 |
| Ethoxylated Tetraethylene-pentaimine | 1.0 | — |
| Brightener 3[1] | 0.1 | — |
| Lipolase lipase[2] (100,000 LU/g) | 0.1 | 0.1 |
| Protease[3] (34 g/L) | 1.0 | — |
| Savinase[2] (44.0 KNPU/g) | — | 2.0 |
| Maxamyl[3] (300 KNU) | — | 0.1 |
| CAREZYME ™ cellulase (100 CEVU/g)[2] | 0.1 | — |
| Monoethanol Amine | 0.1 | — |
| Sodium Hydroxide | 3.0 | — |
| Refined glycerine | — | 1.0 |
| Potassium Hydroxide | — | 9.0 |
| 1,2-Propanediol | 2.0 | 0.1 |
| Cumene Sulfonate, Na | 6.0 | — |
| Soil Release Polymer[4] | 0.5 | 1.0 |
| Perfume | 0.3 | 0.3 |
| Miscellaneous (water, etc.) | balance | balance |
| Total: | 100.0 | 100.0 |

[1]Purchased from Ciba-Geigy
[2]Purchased from Novo Nordisk A/S
[3]Purchased from Genencor
[4]Made according to U.S. PAT. NO. 5,415,807 issued May 16, 1995 to Gosselink et al

EXAMPLE XXVII

This Example illustrates the process of making the builder of the present invention. 2.5 kg/hr of calcite commercially purchased from Omya, Inc., is continuously inputted into the chamber of a Alpine Fluid Bed Jet Mill (Model 100 AFG Fluid Bed Jet Mill commercially available from Hosokawa Micron—Alpine, Germany) having an Air Classifier such as Alpine Air Classifier (Model 50 ATP Air Classifier commercially available from Hosokawa Micron—Alpine, Germany) mounted thereon. The Fluid Bed Jet Mill and Air Classifier apparatus are operated with the valve (E12) set open, throttle flap valve set to adjust air chamber to 0 air pressure, Air Classifier speed set at 8000 rpms, grinding valve set at 5 bar pressure, and the product feed screw set at 35% of maximum. The air pressure of the rinse air in the Fluid Bed Jet Mill are set at 0.5 to 0.6 bars, after which the desired crystalline calcium carbonate builder having a rhombohedral crystalline structure with {1,0,-1,1} crystallographic indices is obtained.

Having thus described the invention in detail, it will be clear to those skilled in the art that various changes may be made without departing from the scope of the invention and the invention is not to be considered limited to what is described in the specification.

What is claimed is:

1. A detergent composition comprising:

(a) an effective amount of crystalline calcium carbonate, said crystalline calcium carbonate substantially having a rhombohedral crystalline structure with {1,0,-1,1} crystallographic indices; and (b) at least 1% by weight of a detersive surfactant.

2. A detergent composition according to claim 1 wherein said detergent composition is substantially free of phosphates.

3. The detergent composition of claim 1 wherein said detergent composition is substantially free of soluble silicates.

4. The detergent composition of claim 1 further comprising sodium sulfate and sodium carbonate in a weight ratio of about 1:20 to about 2:1.

5. The detergent composition of claim 1 wherein said detergent composition is substantially free of polycarboxylates.

6. The detergent composition of claim 1 further comprising a premix containing polycarboxylate and said detersive surfactant.

7. The detergent composition of claim 1 wherein said crystalline calcium carbonate is calcite.

8. The detergent composition of claim 1 wherein said crystalline calcium carbonate is present in an amount of from about 0.1% to about 80% by weight.

9. The detergent composition of claim 1 further comprising sodium carbonate in a weight ratio of with said crystalline calcium carbonate of from about 1:1 to about 5:1.

10. The detergent composition of claim 1 further comprising from about 0.01% to about 5% of potassium salts.

11. The detergent composition of claim 1 wherein said crystalline calcium carbonate has a median particle size of from about 0.2 microns to about 20 microns.

12. The detergent composition of claim 1 wherein said crystalline calcium carbonate has a surface area of from about 0.1 $m^2/g$ to about 4 $m^2/g$.

13. A detergent composition comprising:

(a) from about 0.1% to about 80% by weight of crystalline calcium carbonate, said crystalline calcium carbonate substantially having a rhombohedral crystalline structure with {1,0,-1,1} crystallographic indices and a surface area of from about 0.01 $m^2/g$ to about 4 m2/g;

(b) at least about 1% by weight of a detersive surfactant; and (c) from about 2% to about 80% by weight of sodium carbonate, wherein said sodium carbonate and said crystalline calcium carbonate are in a weight ratio of about 1:1 to about 5:1;

wherein said detergent composition is substantially free of phosphates.

14. The detergent composition of claim 13 further comprising a premix containing polycarboxylate and said detersive surfactant.

15. The detergent composition of claim 13 wherein said crystalline calcium carbonate is calcite.

16. The detergent composition of claim 13 wherein said crystalline calcium carbonate has a median particle size of from about 0.4 microns to about 10 microns.

17. A method for laundering soiled fabrics comprising the steps of contacting said soiled fabrics with an aqueous solution containing an effective amount of a detergent composition according to claim 1.

18. A method for cleaning surfaces comprising the steps of contacting said surfaces with an aqueous solution containing an effective amount of a detergent composition according to claim 1.

19. A detergent composition according to claim 1 which is in the form of a laundry bar.

20. A method of removing calcium hardness ions from an aqueous solution comprising the step of dispersing crystalline calcium carbonate substantially having a rhombohedral crystalline structure with {1,0,-1,1} crystallographic indices into said aqueous solution, said calcium hardness ions crystallizing on said crystalline calcium carbonate resulting in the removal of said calcium hardness ions from said aqueous solution.

21. The detergent composition of claim 1 wherein said crystalline calcium carbonate has a calcium ion exchange capacity of at least about 400 mg equivalent of calcium carbonate hardness/gram of said crystalline calcium carbonate.

22. The detergent composition of claim 1 wherein said crystalline calcium carbonate has a calcium carbonate hardness ion exchange rate of between about 20 ppm $CaCO_3$/minute per 200 ppm of said crystalline calcium carbonate and about 100 ppm $CaCO_3$/minute per 200 ppm of said crystalline calcium carbonate.

23. The detergent composition of claim 13 wherein said crystalline calcium carbonate has a calcium ion exchange capacity of at least about 400 mg equivalent of calcium carbonate hardness/gram of said crystalline calcium carbonate.

24. The detergent composition of claim 13 wherein said crystalline calcium carbonate has a calcium carbonate hardness ion exchange rate of from about 20 ppm $CaCO_3$/minute per 200 ppm of said crystalline calcium carbonate to about 100 ppm $CaCO_3$/minute per 200 ppm of said crystalline calcium carbonate.

25. The method of claim 20 wherein said crystalline calcium carbonate has a median particle size of from about 0.2 microns to about 20 microns.

26. The method of claim 20 wherein said crystalline calcium carbonate has a surface area of from about 0.01 $m^2/g$ to about 4 $m^2/g$.

27. The method of claim 20 wherein said crystalline calcium carbonate has a surface area of from about 0.2 $m^2/g$ to about 4 $m^2/g$.

28. The method of claim 20 wherein said crystalline calcium carbonate has a calcium ion exchange capacity of at least about 400 mg equivalent of calcium carbonate hardness/gram of said crystalline calcium carbonate.

29. The method of claim 20 wherein said crystalline calcium carbonate has a calcium carbonate hardness ion exchange rate of at least about 5 ppm $CaCO_3$/minute per 200 ppm of said crystalline calcium carbonate.

30. The method of claim 20 wherein said crystalline calcium carbonate has a calcium carbonate hardness ion exchange rate of between about 20 ppm $CaCO_3$/minute per 200 ppm of said crystalline calcium carbonate and about 100 ppm $CaCO_3$/minute per 200 ppm of said crystalline calcium carbonate.

* * * * *